US008849140B2

(12) United States Patent
Saito

(10) Patent No.: US 8,849,140 B2
(45) Date of Patent: Sep. 30, 2014

(54) IMAGE FORMING APPARATUS INCLUDING FEED PERMISSION CONTROL THAT DEPENDS ON HEATING POWER OF THE FUSING APPARATUS

(75) Inventor: Kazuya Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 610 days.

(21) Appl. No.: 13/041,567

(22) Filed: Mar. 7, 2011

(65) Prior Publication Data

US 2011/0229180 A1 Sep. 22, 2011

(30) Foreign Application Priority Data

Mar. 16, 2010 (JP) ..... 2010-059155

(51) Int. Cl.
*G03G 15/20* (2006.01)

(52) U.S. Cl.
USPC ..... 399/69; 399/67; 399/68

(58) Field of Classification Search
USPC ..... 399/68, 69, 67
See application file for complete search history.

(56) References Cited

U.S. PATENT DOCUMENTS

2006/0051117 A1* 3/2006 Nishida ..... 399/69
2010/0014903 A1 1/2010 Seto et al.
2010/0104307 A1* 4/2010 Shinyama ..... 399/68
2010/0232844 A1 9/2010 Saito et al.
2010/0239292 A1 9/2010 Fujita et al.

FOREIGN PATENT DOCUMENTS

JP 57-67970 4/1982
JP 2001-265161 9/2001
JP 2001265161 A * 9/2001 ..... G03G 15/20
JP 2007-226028 9/2007
JP 2009276580 A * 11/2009

* cited by examiner

*Primary Examiner* — Billy Lactaoen
(74) *Attorney, Agent, or Firm* — Oblon, Spivak, McClelland, Maier & Neustadt, L.L.P.

(57) ABSTRACT

An image forming apparatus includes a fusing apparatus including a fusing member; a heating unit heating the fusing member; temperature detecting units detecting temperatures of the fusing member and a pressing member; and the pressing member forming a fusing nip with the fusing member for fusing an un-fused image on a recording medium onto a recording medium. The image forming apparatus further includes a heating power determining unit determining heating power of the fusing apparatus by measuring a time or a gradient of time versus temperature before the temperature of the fusing member reaches a reload temperature after power is turned on. The image forming apparatus includes a control unit performing a feed permission control or a CPM down control depending on the heating power of the fusing apparatus and the number of sheets of the recording medium to be passed through the fusing apparatus.

12 Claims, 4 Drawing Sheets

IMAGE FORMING APPARATUS INCLUDING FEED PERMISSION CONTROL THAT DEPENDS ON HEATING POWER OF THE FUSING APPARATUS

BACKGROUND OF THE INVENTION

1. Technical Field

The present invention relates to image forming apparatuses, such as electrophotographic copy machines, printers, and facsimile machines.

2. Description of the Related Art

In a conventional image forming apparatus, an image transferred from an image carrier onto a recording medium is fused onto the recording medium using a combination of heat and pressure, thus obtaining a copied or recorded material. During the fusing process, the recording medium is typically pressed and held between a fusing roller and a pressure roller while the un-fused image on the recording medium is heated. In this way, a developing material in the un-fused image, such as toner, is caused to melt and penetrate the recording medium, thus fixing the toner onto the recording medium.

In such an image forming apparatus, the thickness of the core of the fusing roller may be reduced to reduce the heat-storing effect of the roller in order to reduce power consumption during a warm-up period. Power supplied to a heat source may also be reduced. However, in an image forming apparatus that requires a high processing speed, such as copy machines, the amount of heat transferred to the recording medium may be greater than the amount of heat supplied to the fusing roller from a heat source (such as a halogen heater). In this case, the temperature of the fusing roller decreases during a continuous copy operation.

When the temperature of the fusing roller or the pressure roller is lower than a certain minimum temperature, a sufficient amount of heat cannot be supplied to the recording medium. As a result, the recording medium is passed via a fusing nip formed between the fusing roller and a fusing belt, for example, before the toner is sufficiently melted, thus failing to fuse the toner onto the recording medium properly.

In order to obtain required fusing properties, a "CPM (copy per minute) down" control may be performed. In this operation, when the temperature of the fusing roller or the pressure roller drops below a certain value, the intervals of sheets of the recording medium as they are fed to the fusing nip are increased so that a sufficient time can be ensured for the fusing roller or the pressure roller to be sufficiently heated for the fusing operation.

Japanese Laid-Open Patent Publication No. 2007-226028 ("Patent Document 1") discloses a technology for eliminating control error immediately after reload and for improving fusing quality. In this technology, a sheet size and a paper type are detected upon entry into a copy operation from a standby status, and then a number of sheets for starting CPM down control (which may be referred to as a "CPM down control starting number") is determined. The CPM down control starting number is then corrected by detecting the temperature of the fusing roller at the start of feeding a sheet. The number of sheets that have been continuously fed is counted, and the CPM down control starting number is modified depending on the number of continuously fed sheets.

Japanese Laid-Open Patent Publication No. 57-67970 ("Patent Document 2") discloses that power supply variations are checked and a decrease in fusing temperature and its recovery time are predicted based on the power supply variations and a set number of copied sheets. The copy rate per unit time may be decreased in advance in accordance with the prediction.

However, the conventional fusing error preventing measures have not been optimized for the heating power of the particular fusing apparatus or the number of sheets fed. As a result, the fusing apparatus may be heated longer than necessary, thereby extending the wait time for the user or the time required for printing a number of sheets, resulting in a decrease in productivity.

SUMMARY OF THE INVENTION

According to an embodiment of the present invention, an image forming apparatus includes a fusing apparatus, a unit configured to obtain a print job sheet number, a heating power determining unit determining heating power of the fusing apparatus by measuring a time or a gradient of time versus temperature before the temperature of the fusing member reaches a reload temperature defining a minimum temperature at which the recording medium can be fed through the fusing apparatus, after the image forming apparatus is turned on; and a control unit performing a feed permission control or a CPM down control depending on the heating power of the fusing apparatus and the print job sheet number. The fusing apparatus includes a fusing member; a heating unit heating the fusing member; a first temperature detecting unit detecting a temperature of the fusing member; a pressing member disposed opposite to the fusing member and forming a fusing nip with the fusing member for fusing an un-fused image on a recording medium onto the recording medium; and a second temperature detecting unit detecting a temperature of the pressing member. The feed permission control permits the feeding of the recording medium when the temperature of the pressing member reaches a feed permitting temperature.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION OF THE PREFERRED EMBODIMENTS

Figure 1:
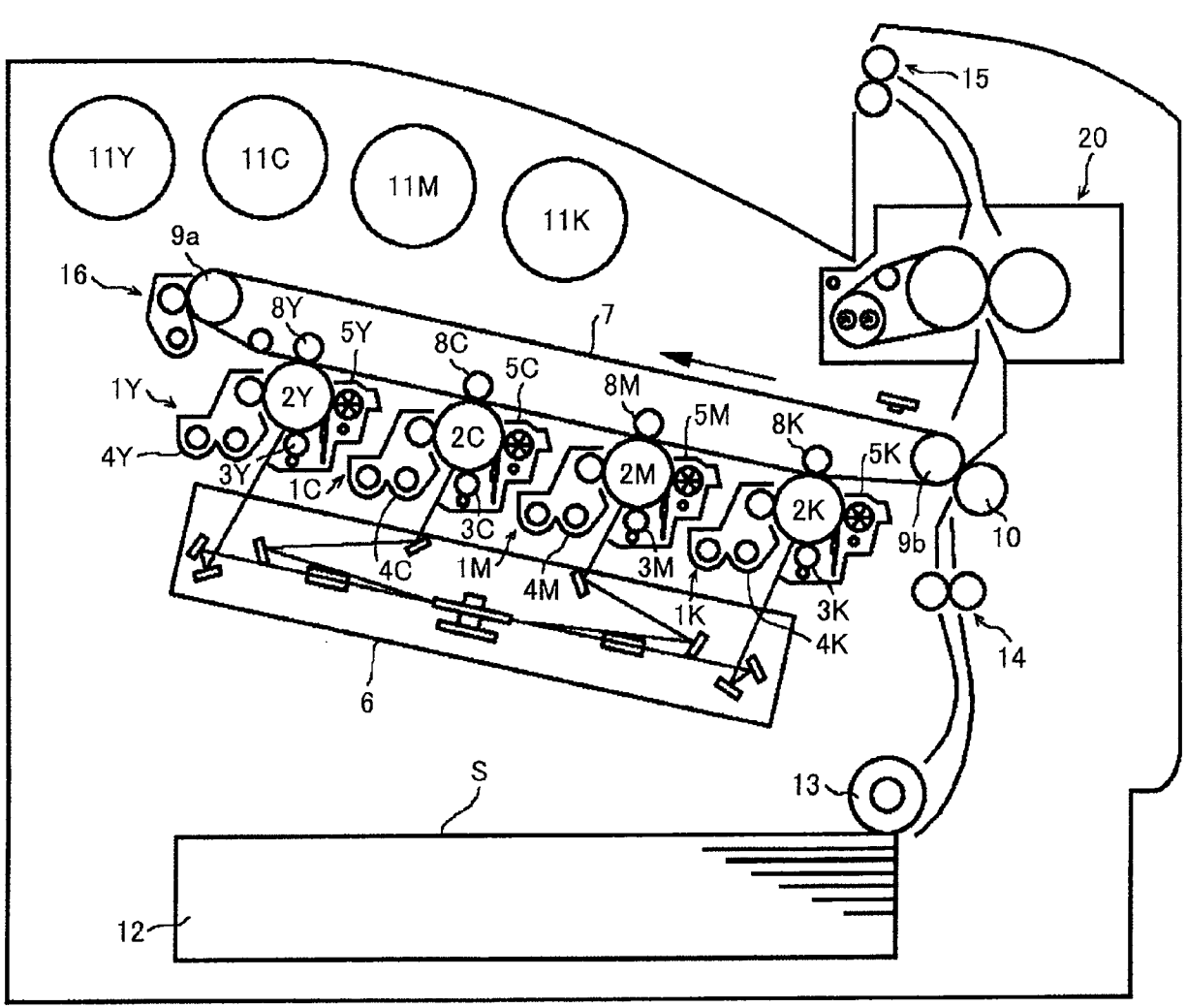
FIG. 1 is a schematic lateral cross section of a color printer according to an embodiment of the present invention.

Embodiments of the present invention are described with reference to the drawings. FIG. 1 is a cross section of a color printer 100 as an example of an image forming apparatus according to an embodiment of the present invention. The color printer 100 includes a fusing apparatus 20. The color printer 100 includes plural (four in the illustrated example) image forming units 1Y, 1C, 1M, and 1K. The image forming units 1Y, 1C, 1M, and 1K may have the same structures and only differ in the color of toner they use.

In the illustrated example, the image forming units 1Y, 1C, 1M, and 1K are configured to form toner images of yellow, cyan, magenta, and black, respectively. Thus, in the following description, any of the image forming units 1Y, 1C, 1M, and 1K may be referred to as "the image forming unit 1" for ease of description and understanding. For the same reason, the various components of the image forming units 1Y, 1C, 1M, and 1K, such as photosensitive drums and charging units described below, may be referred to without designating their corresponding colors with the letters "Y", "C", "M", or "K".

The image forming unit 1 includes a photosensitive drum 2 which is an electrostatic latent image carrier. Around the photosensitive drum 2, a charging unit 3, a developing unit 4, and a cleaning unit 5 are disposed. The photosensitive drum 2 is rotated in the clockwise direction. The charging unit 3 includes an idler roller in pressure-contact with a surface of the photosensitive drum 2. Thus, the charging unit 3 is idly rotated by the rotation of the photosensitive drum 2. The charging unit 3 is supplied with a bias voltage from a high-voltage power supply (not illustrated) in order to uniformly charge the surface of the rotating photosensitive drum 2. Instead of the idler roller contacting the photosensitive drum 2 as in the illustrated example, the charging unit 3 may include a contactless charging mechanism based on corona discharge, for example.

Under the image forming unit 1, an exposing unit 6 is provided. The exposing unit 6 may include a light source, a polygon mirror, an f-θ lens, and reflecting mirrors. The exposing unit 6 is configured to expose the charged surface of the photosensitive drum 2, based on image information of image data corresponding to the respective colors of toner. As a result, an electrostatic latent image is formed on the photosensitive drum 2. The electrostatic latent image is then passed through the developing unit 4 by the rotation of the photosensitive drum 2. The developing unit 4 causes the toner of the corresponding color to adhere to the latent image, thus making the latent image visible. Required amounts of the toner of the various colors may be supplied from toner bottles 11Y, 11C, 11M, and 11K disposed at an upper portion of the color printer 100 via toner transport channels (not illustrated).

Opposite the photosensitive drum 2 of the image forming unit 1, an intermediate transfer belt 7 is disposed, which is an intermediate transfer body in the form of an endless belt. A surface of the intermediate transfer belt 7 is in contact with the photosensitive drum 2. The intermediate transfer belt 7 may be wound across support rollers 9*a* and 9*b*. The support roller 9*a* may be connected to a drive motor (not illustrated) so that the intermediate transfer belt 7 can be rotated in the counterclockwise direction by the support roller 9*a*. The support roller 9*b* may be idly rotated as the intermediate transfer belt 7 is rotated.

Within the enclosed space of the intermediate transfer belt 7, primary transfer rollers 8Y, 8C, 8M, and 8K (which may be hereafter referred to as "the primary transfer roller 8") are disposed opposite the corresponding photosensitive drums 2 across the intermediate transfer belt 7. The primary transfer roller 8 is supplied with a primary transfer bias from a high-voltage power supply (not illustrated) in order to transfer the developed toner image onto the intermediate transfer belt 7 for primary transfer. The toner that has not been transferred by the primary transfer operation and remains on the photosensitive drum 2 is removed by the cleaning unit 5 to prepare the photosensitive drum 2 for the next image forming operation.

A secondary transfer roller 10 is disposed opposite the support roller 9*b* across the intermediate transfer belt 7. The secondary transfer roller 10, the support roller 9*b*, and the intermediate transfer belt 7 between them form a secondary transfer nip. The color printer 100 also includes a sheet-feeding cassette 12 for stocking the recording media S, a feeding roller 13, and a registration roller pair 14. The fusing apparatus 20 and a sheet-ejecting roller pair 15 are provided downstream of a direction of transport of the recording medium S.

An image forming operation performed by the color printer 100 is described. First, the photosensitive drum 2 is rotated by the drive source (not illustrated) in the clockwise direction, while the surface of the photosensitive drum 2 is irradiated with light from a neutralizing unit (not illustrated), whereby surface potential is initialized. Then, the surface of the photosensitive drum 2 is uniformly charged with a predetermined polarity by the charging unit 3.

The charged surface of the photosensitive drum 2 is irradiated with laser light from the exposing unit 6, forming an electrostatic latent image on the surface of the photosensitive drum 2. The laser light may be modulated with image information of the corresponding color, i.e., yellow, cyan, magenta, or black of a desired full-color image. When the electrostatic latent image formed on the photosensitive drum 2 is passed through the developing unit 4, the toner (developer) of the corresponding color is supplied from the developing unit 4 and adhered onto the latent image, thus producing a visible toner image.

While the intermediate transfer belt 7 is rotated in the counterclockwise direction in FIG. 1, the primary transfer roller 8 is supplied with a primary transfer voltage having an opposite polarity to that of the toner image on the photosensitive drum 1. Thus, a transfer electric field is formed between the photosensitive drum 2 and the intermediate transfer belt 7. As a result, the toner image on the photosensitive drum 2 is electrostatically transferred onto the intermediate transfer belt 7 for primary transfer as the intermediate transfer belt 7 is rotated in synchronism with the photosensitive drum 2. Thus, the toner image of the corresponding color is transferred onto the intermediate transfer belt 7 and superposed one color upon another successively from an upstream side (yellow end) of the direction of movement of the intermediate transfer belt 7 at appropriate timings, thus forming a desired full-color image thereon.

The recording medium S is picked out of a stack of the recording media S in the sheet-feeding cassette 12 one sheet at a time, and then fed via a transport unit including the feeding roller 13, to the registration roller pair 14. When the front-edge of the recording medium S abuts a nip of the registration roller pair 14 and forms a loop before the roller pair 14 is rotated, the recording medium S is registered. Thereafter, the registration roller pair 14 is rotated in accordance with the timing of transfer of the full-color toner image on the intermediate transfer belt 7, whereby the recording medium S is sent toward the secondary transfer nip between the support roller 9*b* and the secondary transfer roller 10.

In accordance with the present embodiment, the secondary transfer roller 10 is provided with a transfer voltage having a polarity opposite to that of the toner of the toner image on the surface of the intermediate transfer belt 7. Thus, the full-color toner image formed on the surface of the intermediate transfer belt 7 is transferred onto the recording medium S. The recording medium S is then transported to the fusing apparatus 20 where heat and pressure are applied to permanently fuse the toner image onto the recording medium S. The recording medium S is then ejected onto a recording medium stacking unit, such as a stacking tray, via the sheet-ejecting roller pair 15, thus completing the image forming operation. The toner that has not been transferred at the secondary transfer nip and remains on the intermediate transfer belt 7 is removed by a cleaning unit 16.

Figure 2:
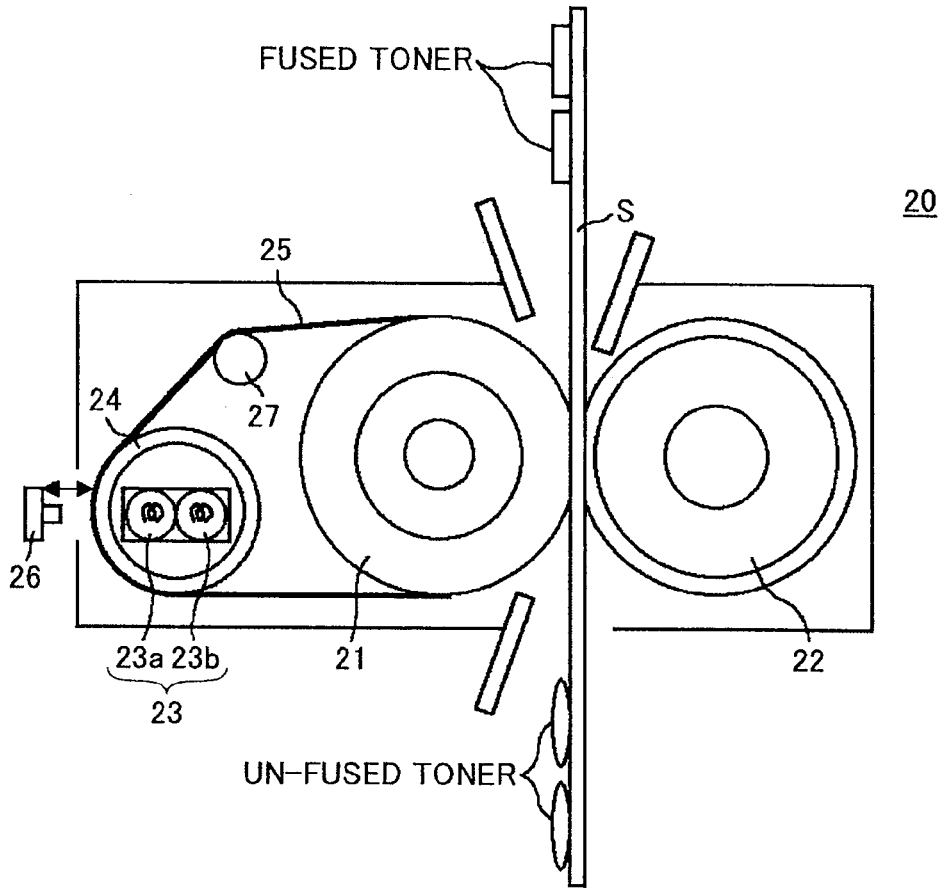
FIG. 2 is a schematic cross section of a fusing apparatus according to an embodiment of the present invention.
Figure 3:
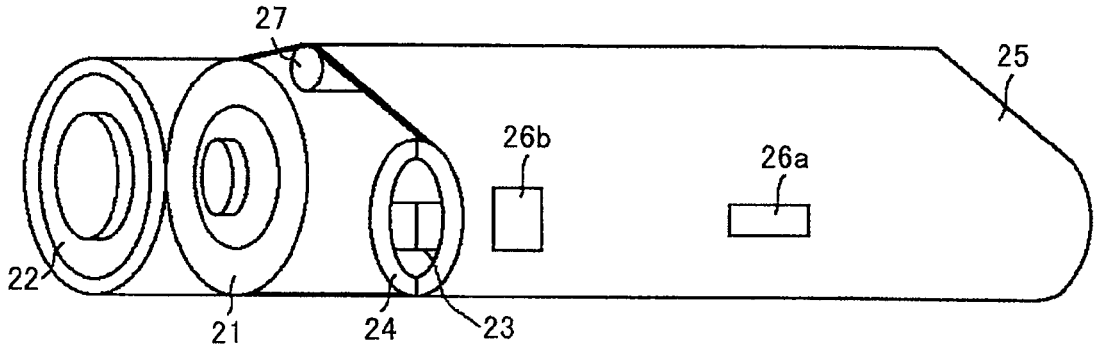
FIG. 3 is a schematic perspective view of the fusing apparatus as seen from a heating roller side.
Figure 4:
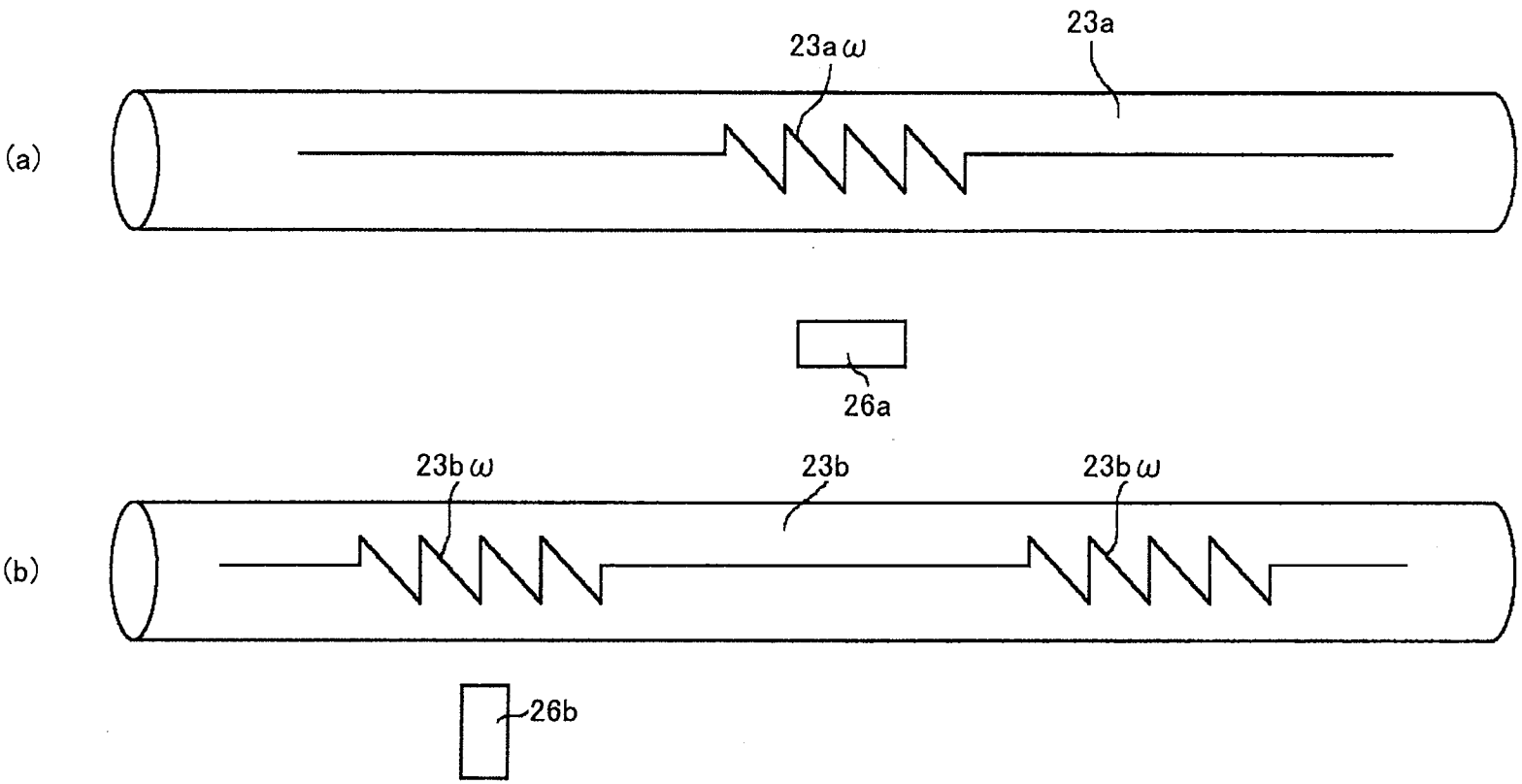
FIGS. 4(*a*) and 4(*b*) are longitudinal views of heaters and contactless temperature sensors in a heating unit of the fusing apparatus.

With reference to FIGS. 2 through 4, the fusing apparatus 20 is described. FIG. 2 is a schematic cross section of the fusing apparatus 20. FIG. 3 is a schematic perspective view of the fusing apparatus 20 as seen from the side of the heating roller 24. FIGS. 4(*a*) and 4(*b*) illustrate a positional relationship between a heating unit 23 and a contactless temperature sensor 26 in the fusing apparatus 20.

The fusing apparatus 20 includes a fusing belt 25 extended across a fusing roller 21 and a heating roller 24, and a pressure roller 22 disposed opposite to the fusing roller 21. The fusing belt 25 is internally pressed by a tension roller 27 in order to provide the fusing belt 25 with an appropriate tension. The pressure roller 22 is pressed against the fusing roller 21 via the fusing belt 25, forming a fusing nip between the fusing belt 25 and the pressure roller 22. The fusing nip is heated by the heating roller 24 which is heated by a heating operation of the heating unit 23.

When the recording medium S is held and transported in the fusing nip, the pressure provided by the pressure roller 22 and the heat from the fusing belt 25 are applied to the recording medium S. As a result, the toner image is melted and fused onto the recording medium S. In accordance with the present embodiment, the heating unit 23 is contained within the heating roller 24 and includes a central heater 23*a* and an end heater 23*b*.

The fusing belt 25 includes a base material with a sufficient heat resistance on which a resilient layer adapted to absorb surface irregularities of the recording medium S is formed. The base material may include polyimide resin with a thickness of 80 μm. The resilient layer may include a silicone rubber layer with a thickness of 200 μm. Further, a PFA (tetrafluoroethylene/perfluoroalkylvinylether copolymer) layer with a thickness of 10 μm may be layered on the resilient layer. When the resilient layer has good releasing properties with respect to toner or paper powder and the like, the PFA layer may be dispensed with.

In order to form a fusing nip capable of applying an appropriate surface pressure to the recording medium S with an appropriate nipping width, the fusing roller 21 and the pressure roller 22 may be made of a resilient material such as rubber, or a foam material such as sponge. In accordance with the present embodiment, the fusing roller 21 includes a sponge roller with a hardness of 35 Hs, and the pressure roller 22 includes a rubber surface with a thickness of 3 mm and a hardness of 60 Hs.

During rotation, the fusing belt 25 may be displaced toward and even beyond either end of the fusing roller 21 or the heating roller 24. To prevent such belt displacement, a side guide (not illustrated) may be provided so that the displacement of the fusing belt 25 can be regulated upon contacting the side guide.

FIG. 4(*a*) is a longitudinal view of the central heater 23*a* of the heating unit 23. FIG. 4(*b*) is a longitudinal view of the end heater 23*b* of the heating unit 23. The central heater 23*a* and the end heater 23*b* are controlled using separate contactless temperature sensors 26*a* and 26*b*. Three or more of the contactless temperature sensors may be provided. By providing the central heater 23*a* and the end heater 23*b* in the heating unit 23, an unnecessary increase in temperature at the ends of the heating unit 23 can be prevented, and power consumption can be reduced by varying the duty cycle of the heaters 23*a* and 23*b* individually, depending on the size of the recording medium S. The provision of the two or more heaters may also prevent flickering.

For example, when the size of the recording medium S is large, the central heater 23*a* and the end heater 23*b* are activated with the same duty ratio. When the size of the recording medium S is small, the duty ratio of the end heater 23*b* may be greatly lowered so as to reduce heating in areas that need not be heated, thus eliminating wasteful power consumption. Thus, by providing the two heaters in the heating unit 23, different portions of the heating roller 24 and the fusing belt 25 can be heated. Alternatively, the heating unit 23 may include three or more heaters, or it may consist of a single heater. A number of the contactless temperature sensors 26 may be provided at positions corresponding to the heaters in the heating unit 23 so that the heaters can be controlled individually.

While the fusing belt 25 is heated from the inside by the heating unit 23 in accordance with the present embodiment, a heating unit according to another embodiment may be configured to heat the fusing belt 25 from the outside using radiant heat from a halogen heater. Alternatively, the heating unit may include an inductive heating unit or a magnetic heating unit.

The contactless temperature sensors 26*a* and 26*b* are disposed outside the central heater 23*a* and the end heater 23*b*, respectively, at positions corresponding to a heating resistor 23*a*ω of the central heater 23*a* and a heating resistor 23*b*ω of the end heater 23*b*, respectively. The contactless temperature sensor 26*a* may include a thermopile while the contactless temperature sensor 26*b* may include a thermistor. Thus, by providing the contactless temperature sensors 26*a* and 26*b* at positions corresponding to the different heating positions of the heating unit 23, the temperature of the heating unit 23 can be accurately controlled.

The thermopile in the contactless temperature sensor 26*a* is used as a target temperature sensor having good time response characteristics. The thermopile has a hot junction and a cold junction. When infrared light from a target object is focused at the hot junction, which may include a series connection of a number of thermocouples, an electromotive force corresponding to a temperature difference between the hot junction and the cold junction is produced, thus enabling the measurement of the temperature of the target object. The measurement result may vary depending on the temperature of the thermopile, particularly the temperature of its cold junction. Namely, the measurement result is dependent on an ambient temperature of the sensor. Thus, in order to compensate for the temperature change due to the ambient temperature, an ambient temperature sensor may be provided for measuring the temperature around the target temperature sensor.

The thermistor in the contactless temperature sensor 26*b* includes a thermistor pair whose resistance value varies depending on temperature. The contactless temperature sensor (thermistor) 26*b* may include a target temperature sensor configured to measure the temperature of a target object and an ambient temperature sensor configured to measure the temperature around the target temperature sensor. A temperature value detected by the target temperature sensor may be corrected by a temperature value detected by the ambient temperature sensor. The thermistor may be inferior to the thermopile in response characteristics but may be more advantageous in terms of cost.

The contactless temperature sensors 26*a* and 26*b* may include the same type of sensors instead of the thermopiles and thermistors as in the present embodiment. The contactless temperature sensors 26*a* and 26*b* are not limited to thermopiles and thermistors but may include any sensors capable of measuring the surface temperature of the target object and the ambient temperature so that the surface temperature of the fusing belt 25 can be properly monitored and controlled. In other words, any sensor may be used as long as it is capable of monitoring the surface temperature of the fusing belt 25 so that the required fusing properties of the toner on the recording medium S can be maintained.

Immediately after the color printer 50 (image forming apparatus) is turned on, the heating unit 23 (heat source) is activated while the duty ratios of the heaters 23*a* and 23*b* are controlled depending on the outputs of the contactless temperature sensors 26*a* and 26*b*, thus heating the heating roller 24, the fusing roller 21, and the fusing belt 25. At the same time, the surface temperature of the pressure roller 22 is detected by a temperature detecting unit (not illustrated) within the fusing apparatus 20. When the surface temperature of the pressure roller 22 reaches a predetermined temperature enabling the fusing of the un-fused image onto the sheet, a user may be notified via an operating panel (not illustrated) of the color printer 50 that a copy operation can be performed.

However, when the amount of heat stored in the fusing apparatus 20 (particularly the pressure roller 22) is not sufficient, such as immediately after starting up the apparatus, too much heat in the fusing belt 25 or the fusing roller 21 may be transferred to the pressure roller 22 in contact therewith. In order to heat the fusing belt 25 or the fusing roller 21 sufficiently upon starting up the fusing apparatus 20, for example, more electric power is required than in a stabilized status where the pressure roller 22 already has a sufficient amount of heat. Thus, unless sufficient electric power is supplied, the fusing apparatus 20 cannot maintain the required fusing temperature, resulting in a fusing error.

In order to prevent such a fusing error, a print job may be started while heating the pressure roller 22 with the CPM down control. However, such a control does not take into consideration the heating power of the fusing apparatus 20. Further, because there are variations in heating power depending on input voltage or the tolerance of heater output, an optimum fusing error preventing measure has not been available, resulting in a longer time for printing plural sheets and thus lowering productivity.

Specifically, the degree of decrease in temperature of the fusing apparatus 20 may vary during the sheet feeding period immediately after starting up the apparatus, because of variations in the heating power of the fusing apparatus 20 depending on input voltage or the tolerance of heater output. For example, when the heating power of the fusing apparatus 20 is low, the temperature of the fusing apparatus 20 may decrease greatly upon feeding of a sheet, resulting in a fusing error.

The "tolerance" of heater output refers to the actual range of output of the heater. For example, a heater with a rated output of 500 W may have an actual output range, or tolerance, between 475 W and 525 W. Thus, the heating power of the fusing apparatus 20 may increase or decrease within such a tolerance range. If the heating power of the fusing apparatus 20 is too low, the fusing apparatus cannot maintain a sufficient target fusing temperature due to lack of power. In such a case, it also takes longer to reach a reload temperature (minimum temperature allowing the feeding of sheets).

Thus, in accordance with the present embodiment, the time or a gradient of temperature versus time before the reload temperature is reached is measured in order to determine whether the heating power of the fusing apparatus 20 is normal, i.e., whether the input voltage is close to rated output, or whether the heating power of the fusing apparatus 20 is decreased, i.e., if there is a voltage drop. Then, the subsequent control routine is varied depending on the heating power, for example. Thus, the toner image can be fused and the print job can be completed as quickly as possible while maintaining high image quality even when input voltage is lower than rated output and the temperature of the fusing apparatus 20 is low, such as immediately after starting up the apparatus.

Figure 5:
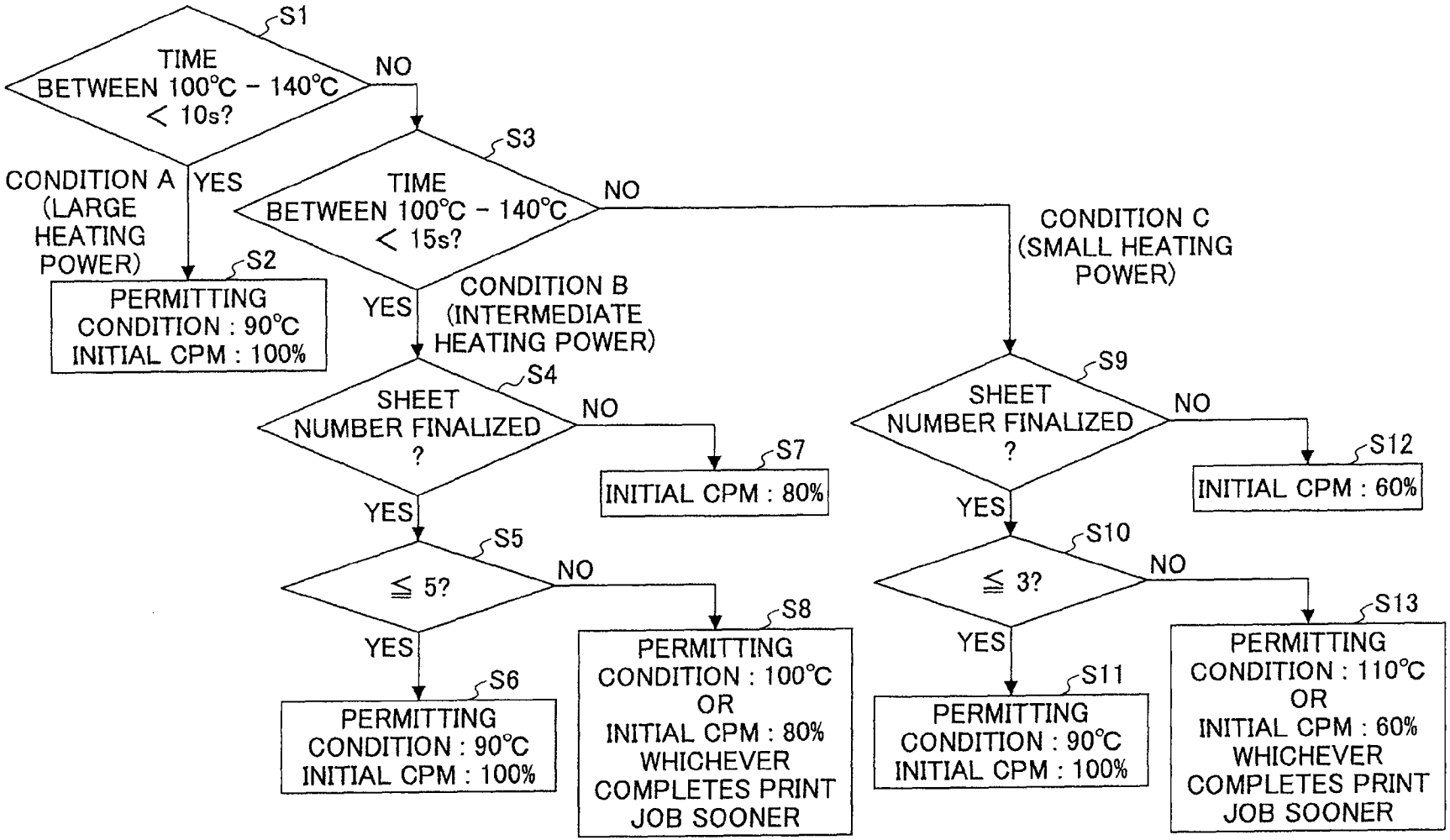
FIG. 5 is a flowchart of a control process performed by the fusing apparatus in accordance with an embodiment of the present invention.

FIG. 5 is a flowchart of a control process in the fusing apparatus 20. In accordance with the present embodiment, the interval of time before the reload temperature on the heating side (heating roller 24, the fusing roller 21, and the fusing belt 25) reaches 140° C. from 100° C. is measured, using a time measuring unit (not illustrated) and the contactless temperature sensors 26*a* and 26*b*. The reload temperature gradually increases after the color printer 100 and the heater 23 are turned on. In this way, the heating power of the fusing apparatus 20 is determined. In other words, the heating power of the fusing apparatus 20 is determined from the above time interval, and then the need for CPM down control is determined and a pressure-feed permitting condition (temperature) for the pressure roller 22 is selected or controlled depending on the heating power, so that an entire print job can be completed as quickly and efficiently as possible without causing a fusing error.

The pressure-feed permitting condition may be selected or controlled depending on the temperature of the pressure roller 22 detected by a temperature detecting unit (not illustrated). The measurement of the heating power of the fusing apparatus 20 may be performed only when the temperature on the heating side is lower than 50° C. upon turning on the heater 23, such as at the time of starting up the image forming apparatus 100.

Referring to FIG. 5, first it is determined whether the time interval before the reload temperature on the heating side reaches 140° C. from 100° C. after turning on the heating unit 23 is 10 seconds or less (step S1). If the time interval is 10 seconds or less, it is determined that there is normal sufficient heating power ("Yes" in step S1), thus satisfying condition "A".

In the case of Condition A, there is sufficient input voltage and sufficient heating power of the fusing apparatus 20. Thus, in this case, sheets can be passed through the fusing apparatus 20 without performing the CPM down control or the like, and high-quality fused images can be obtained. Thus, in the case of Condition A, the sheets are fed at the rate of 100% with respect to the initial CPM, without performing the CPM down control for increasing the sheet feeding interval (step S2). Further, the temperature condition (pressure-feed permitting condition) of the pressure roller 22 for allowing the sheet feeding through the fusing apparatus 20 is set at 90° C. (step S2). Thus, when the temperature on the side of the pressure roller 22 is 90° C. or higher, printing is immediately started. If the temperature is less than 90° C., printing is delayed until the temperature reaches 90° C. In Condition A, sufficient input voltage is available, so that the temperature of the fusing apparatus 20 does not decrease below a lower-limit fusing temperature defining a minimum temperature for proper fusing even when the continuous feeding of sheets is started when the temperature of the pressure roller 22 is 90° C.

On the other hand, when it is determined in step S1 that the time interval is longer than 10 seconds ("No" in step S1), it is determined whether the time interval between 100° C. and 140° C. is 15 seconds or less (step S3). When the time interval is 15 seconds or less, i.e., longer than 10 seconds and not longer than 15 seconds ("Yes" in step S3), it is determined that the heating power is a little less than normal, thus satisfying a condition "B".

In the case of Condition B, there may be a decrease in input voltage, so that the temperature of the fusing apparatus 20 may drop below the lower-limit fusing temperature if a large number of sheets are fed continuously, resulting in a fusing error. Thus, it is determined whether the number of sheets to be fed is determined in step S4, so that the subsequent control can be determined depending on the number of sheets.

When the number of sheets to be fed is finalized ("Yes" in step S4), the information of the number of sheets (which may be referred to as a "print job sheet number") entered by a user on his personal computer or via the operating panel of the apparatus may be sent to a controller (not illustrated) for controlling the fusing apparatus 20. Then, it is determined whether the print job sheet number is five or less, for example (step S5).

In accordance with the present embodiment, the degree of decrease in temperature due to continuous feeding immediately after starting up the apparatus in Condition B may be measured in advance. It may also be known in advance that the lower-limit fusing temperature can be maintained without performing the CPM down control (i.e., 100% initial CPM) and under the normal pressure-feed permitting condition (temperature 90° C.) when the print job sheet number is five or less. Thus, when it is determined in step S5 that the print job sheet number is five or less, printing is started under the normal conditions (step S6).

When it is determined in step S5 that the print job sheet number is six or more ("No" in step S5), a fusing error may occur if printing is started under the normal conditions. Thus, in this case, either fusing is performed while heating the pressure roller 22 with the CPM down control, or fusing is performed after the pressure roller 22 is sufficiently heated by modifying the pressure-feed permitting condition, whichever is capable of completing the print job sooner (step S8).

Either of the above controls is selected because in some cases the print job may be completed sooner by performing only the CPM down control without modifying the pressure-feed permitting condition, and in other cases the print job may be completed sooner by modifying the pressure-feed permitting condition without performing the CPM down control, depending on the heating power and the print job sheet number.

Because the heating power of the fusing apparatus 20 is decreased by a decrease in input voltage, for example, the temperature of the pressure-feed permitting condition in step S8 may be set to be higher than the 90° C. in step S2, namely 100° C., so that the temperature does not decrease below the lower-limit fusing temperature even after continuous feeding. In the case of the CPM down control, the sheet feeding rate may be set to be 80% of the initial CPM, so that fusing can be performed at a greater sheet feeding interval, thus preventing the temperature from dropping below the lower-limit fusing temperature.

When it is determined in step S3 that the time interval is greater than 15 seconds ("No" in step S3), it is determined that the heating power is significantly decreased (condition "C"). In this case, the print job sheet number is determined so as to determine the subsequent control (step S9). In the case of Condition C, the heating power is less than in the case of Condition B. Thus, when the print job sheet number is finalized ("Yes" in step S9), it is determined whether the print job sheet number is three or less, for example (step S10).

When the print job sheet number is three or less ("Yes" in step S10), fusing is started under the normal conditions without performing the CPM down control, i.e., with 100% initial CPM and under the normal pressure-feed permitting condition (temperature 90° C.) (step S11). It may be determined in advance that the lower-limit fusing temperature can be maintained in Condition C when the number of sheets fed is three or less. In the case of Condition C, the heating power of the fusing apparatus 20 may be significantly reduced by a lack of input voltage. Thus, the number of sheets that can be continuously fed is limited to the smallest among the three conditions.

When it is determined in step S10 that the print job sheet number is four or more ("No" in step S10), a fusing error may be caused by a lack of the fusing temperature of the fusing apparatus 20 if printing is started under the normal conditions. Thus, in step S13, either fusing is performed by performing the CPM down control while heating the pressure roller 22, or fusing is performed after the pressure roller 22 is sufficiently heated by modifying the pressure-feed permitting condition, whichever is capable of completing the print job sooner (step S13).

In Condition C, the heating power of the fusing apparatus 20 is significantly less than normal. Thus, the temperature of the pressure-feed permitting condition in step S13 is set to be higher than 100° C. in step S8, i.e., 110° C., so that the temperature is not lowered below the lower-limit fusing temperature even after continuous feeding. Further, in the CPM down control, the sheet feeding rate is set to be lower than the 80% in step S8, namely to 60% with respect to the initial CPM. In this way, fusing is started by further increasing the sheet feeding interval so that the temperature does not decrease below the lower-limit fusing temperature.

When it is determined that the number of sheets fed upon reload is not yet finalized ("No" in step S4 or S9), the CPM down control may be performed in accordance with Condition B or Condition C so that fusing can be started by increasing the sheet feeding interval, thus preventing fusing error. In the illustrated example of FIG. 5, the print job is started by performing the CPM down control at 80% of the initial CPM in Condition B and at 60% of the initial CPM in Condition C.

Thus, in accordance with the present embodiment, the heating power is classified into Condition A, Condition B, or Condition C. Also, the three feed-enabling temperature conditions of 90° C., 100° C., and 110° C. are provided for the pressure roller 22. These conditions may be defined in a table. The heating power may be classified into two or four or more levels. The temperature condition may designate two or four or more temperatures.

Depending on the sheet size or paper type, the amount of heat in the end portions of the heating roller 24 may be insufficient compared to the center portion at the time of reload, resulting in a fusing error in the very first sheet regardless of the print job sheet number. In this case, when it can be expected that the temperature will drop below the lower-limit fusing temperature after several sheets are fed, only the pressure-feed permitting condition may be modified depending on the heating power without selecting the different control routines depending on the number of sheets fed (steps S4, S5, S9, S10) or performing the CPM down control.

For example, the paper type entered by the user via his personal computer or the operating panel of the apparatus may be determined and sent to the controller (not illustrated) controlling the fusing apparatus. The heating power, i.e., Condition A, Condition B, or Condition C is determined in step S1 or S3. In Condition A, 90° C. may be adopted for the pressure-feed permitting condition. In Condition B, 100° C. may be adopted for the pressure-feed permitting condition. In Condition C, 110° C. may be adopted for the pressure-feed permitting condition. By starting printing in those conditions when the pressure roller 22 reaches those respective temperatures, the development of fusing error from the very first sheet may be prevented.

Depending on the sheet size or paper type, printing may take less time by starting the print job by performing the CPM down control, rather than modifying the pressure-feed permitting condition, regardless of the print job sheet number. In such a case, only the CPM down control may be performed depending on the heating power. For example, after the heating power of Condition A, Condition B, or Condition C is determined in step S1 or step S3, the CPM down control may be performed with 100% of the initial CPM in Condition A; the CPM down control may be performed with 80% of the initial CPM in Condition B; and the CPM down control may be performed with 60% of the initial CPM in Condition C. In this way, fusing error may be prevented.

Thus, in accordance with the present embodiment, three CPM factors, i.e., 100%, 80%, and 60% are provided, which may be defined in a table. The CPM factors may be freely set by the user depending on the heating power of the fusing apparatus and print job information. The pressure-feed permitting condition may also be freely set by the user.

Instead of measuring the heating power each time a print job is started, the heating power of the fusing apparatus 20 may be measured only when the temperature on the heating side, such as the heating roller 24, the fusing roller 21, or the fusing belt 25, is lower than 50° C. upon turning on the heater 23, such as upon starting up the apparatus. When the temperature on the heating side is 50° C. or above upon turning on the heater 23, the previous heating power of Condition A, Condition B, or Condition C may be used.

The temperature condition at the start of feeding and the degree of temperature drop after the start of feeding may vary depending on the sheet size or paper type. Thus, the paper type information entered by the user via his personal computer or the operating panel of the apparatus may be sent to the controller (not illustrated) controlling the fusing apparatus, so that the user can set an optimum initial CPM value and an optimum pressure-feed permitting condition independently depending on the paper type. In this way, wait time may be minimized while maximizing productivity.

Fusing error may be caused under various conditions depending on the environment, such as the temperature and humidity of the environment of the fusing apparatus 20. Thus, a temperature/humidity sensor (not illustrated) may be installed near the fusing apparatus in order to monitor ambient temperature or humidity, so that the initial CPM and the pressure-feed permitting condition may be modified depending on the environment. In this way, the possibility of fusing error may be minimized or eliminated while maximizing productivity even when the environment is changed.

The temperature required from the heating side may vary depending on whether the pressure roller 22 is cooled, such as immediately after starting up the apparatus, or it is warmed, such as immediately after a print job. Thus, instead of setting the temperature on the heating side at a constant value, the required temperature on the heating side may be corrected in real-time based on the temperature on the side of the pressure roller 22. In this way, a constant image quality may be maintained even when the temperature of the pressure roller 22 greatly varies, such as immediately after starting up the apparatus and after a print job.

This feature may be particularly effective when the lower-limit fusing temperature greatly varies depending on whether the pressure roller 22 is cooled, such as immediately after starting up the apparatus, or whether it is warmed, such as some time thereafter. The degree of contribution of the application of pressure or heat to fusing properties may vary depending on sheet thickness. Thus, a target temperature correction formula may be modified depending on sheet thickness.

Although this invention has been described in detail with reference to certain embodiments, variations and modifications exist within the scope and spirit of the invention as described and defined in the following claims.

The present application is based on Japanese Priority Application No. 2010-059155 filed Mar. 16, 2010, the entire contents of which are hereby incorporated by reference.

What is claimed is:

1. An image forming apparatus comprising:

a fusing apparatus including a fusing member;

a heating unit configured to heat the fusing member;

a first temperature detecting unit configured to detect a temperature of the fusing member;

a pressing member disposed opposite to the fusing member and configured to form a fusing nip with the fusing member for fusing an un-fused image on a recording medium onto the recording medium; and a second temperature detecting unit configured to detect a temperature of the pressing member;

a first unit configured to obtain a print job sheet number;

a heating power determining unit configured to determine heating power of the fusing apparatus by measuring a time or a gradient of time versus temperature before the temperature of the fusing member reaches a reload temperature defining a minimum temperature at which the recording medium can be fed through the fusing apparatus, after the image forming apparatus is turned on; and a control unit configured to perform a feed permission control or a CPM (copy per minute) down control depending on the heating power of the fusing apparatus and the print job sheet number, wherein the feed permission control permits the feeding of the recording medium when the temperature of the pressing member reaches a feed permitting temperature, wherein the control unit is configured to perform a first control when the time or the gradient is equal to or less than a first predetermined value, the first control including the feed permission control permitting the feeding of the recording medium when the temperature of the pressing member reaches a first feed permitting temperature without performing the CPM down control, wherein, when the time or the gradient is greater than the first predetermined value, the control unit is configured to perform the first control, a second control, or a third control based on a prediction of a degree of decrease of the temperature of the fusing member after the feeding of one or more sheets of the recording medium, and wherein the second control and the third control include selecting the feed permission control or the CPM down control, whichever control is capable of completing the output of a number of sheets of the recording media corresponding to the print job sheet number.

2. The image forming apparatus according to claim 1, wherein the control unit is configured to perform the prediction based on the heating power and the print job sheet number, wherein the second control includes selecting either the feed permission control permitting the feeding of the recording medium when the temperature of the pressure member reaches a second feed permission temperature, or the CPM down control performed at a first predetermined rate, wherein the third control includes selecting either the feed permission control permitting the feeding of the recording medium when the temperature of the pressing member reaches a third feed permitting temperature, or the CPM down control performed at a second predetermined rate.

3. The image forming apparatus according to claim 1, wherein, when the time or the gradient is greater than the first predetermined value and equal to or less than a second predetermined value, the first control or the second control is performed, and when the time or the gradient is greater than the second predetermined value, the first control or the third control is performed.

4. The image forming apparatus according to claim 1, wherein, when the time or the gradient is greater than the first predetermined value, the second control or the third control is performed when the print job sheet number is greater than a predetermined number.

5. The image forming apparatus according to claim 2, wherein the second predetermined rate is less than the first predetermined rate.

6. The image forming apparatus according to claim 2, wherein, when the time or the gradient is greater than the first predetermined value and the print job sheet number is not finalized at the time of reload, only the CPM down control is performed at the first predetermined rate or the second predetermined rate instead of the first control, the second control, or the third control.

7. The image forming apparatus according to claim 1, wherein the feed permission control or the CPM down control is selected depending on the temperature of the fusing member and the temperature of the pressing member detected by the first and the second temperature detecting units, regardless of the print job sheet number.

8. The image forming apparatus according to claim 1, further comprising a second unit configured to obtain information of a type of the recording medium, wherein an initial CPM value and the feed permitting temperature can be independently set depending on the type of the recording medium.

9. The image forming apparatus according to claim 1, further comprising a second unit configured to obtain information of a temperature or humidity near the fusing apparatus, wherein an initial CPM value and the feed permitting temperature can be independently set depending on the information of the temperature or humidity.

10. The image forming apparatus according to claim 1, wherein a target temperature of the fusing member is varied in a real-time manner based on the temperature of the pressing member.

11. An image forming apparatus comprising:

a fusing apparatus including a fusing member;

a heating unit configured to heat the fusing member;

a first temperature detecting unit configured to detect a temperature of the fusing member;

a pressing member disposed opposite to the fusing member and configured to form a fusing nip with the fusing member for fusing an un-fused image on a recording medium onto the recording medium; and a second temperature detecting unit configured to detect a temperature of the pressing member;

a first unit configured to obtain a print job sheet number;

a heating power determining unit configured to determine heating power of the fusing apparatus by measuring a time or a gradient of time versus temperature before the temperature of the fusing member reaches a reload temperature defining a minimum temperature at which the recording medium can be fed through the fusing apparatus, after the image forming apparatus is turned on; and a control unit configured to perform a feed permission control or a CPM (copy per minute) down control depending on the heating power of the fusing apparatus and the print job sheet number, wherein the feed permission control permits the feeding of the recording medium when the temperature of the pressing member reaches a feed permitting temperature, wherein the control unit is configured to perform a first control when the time or the gradient is equal to or less than a first predetermined value, the first control including the feed permission control permitting the feeding of the recording medium when the temperature of the pressing member reaches a first feed permitting temperature without performing the CPM down control, wherein, when the time or the gradient is greater than the first predetermined value, the control unit is configured to perform the first control, a second control, or a third control based on a prediction of a degree of decrease of the temperature of the fusing member after the feeding of one or more sheets of the recording medium, and wherein, when the time or the gradient is greater than the first predetermined value, the first control is performed when the print job sheet number is equal to or less than a predetermined number.

12. An image forming apparatus comprising:

a fusing apparatus including a fusing member;

a heating unit configured to heat the fusing member;

a first temperature detecting unit configured to detect a temperature of the fusing member;

a pressing member disposed opposite to the fusing member and configured to form a fusing nip with the fusing member for fusing an un-fused image on a recording medium onto the recording medium; and a second temperature detecting unit configured to detect a temperature of the pressing member;

a first unit configured to obtain a print job sheet number;

a heating power determining unit configured to determine heating power of the fusing apparatus by measuring a time or a gradient of time versus temperature before the temperature of the fusing member reaches a reload temperature defining a minimum temperature at which the recording medium can be fed through the fusing apparatus, after the image forming apparatus is turned on; and a control unit configured to perform a feed permission control or a CPM (copy per minute) down control depending on the heating power of the fusing apparatus and the print job sheet number, wherein the feed permission control permits the feeding of the recording medium when the temperature of the pressing member reaches a feed permitting temperature, wherein the control unit is configured to perform a first control when the time or the gradient is equal to or less than a first predetermined value, the first control including the feed permission control permitting the feeding of the recording medium when the temperature of the pressing member reaches a first feed permitting temperature without performing the CPM down control, wherein, when the time or the gradient is greater than the first predetermined value, the control unit is configured to perform the first control, a second control, or a third control based on a prediction of a degree of decrease of the temperature of the fusing apparatus after the feeding of one or more sheets of the recording medium, and wherein a second feed permitting temperature is greater than the first feed permitting temperature, and a third feed permitting temperature is greater than the second feed permitting temperature so that when the temperature of the pressing member reaches the second feed permitting temperature and the third feed permitting temperature, the control unit performs the second control and the third control, respectively, to permit the feeding of the recording medium without performing the CPM down control.

* * * * *